US005295693A

United States Patent [19]

Dobson

[11] Patent Number: 5,295,693

[45] Date of Patent: Mar. 22, 1994

[54] GAME OF SKILL

[76] Inventor: John Dobson, R.R. #2, Burford, Ontario, Canada

[21] Appl. No.: 843,194

[22] Filed: Feb. 28, 1992

[51] Int. Cl.[5] ..... A63B 67/00; A63F 9/00

[52] U.S. Cl. ..... 273/441; 273/108; 273/109; 273/116; 273/118 R; 273/123 R

[58] Field of Search ..... 273/108, 109, 113, 115, 273/116, 118 R, 118 A, 121 R, 121 A, 123 R, 124 R, 125 R, 440, 441, 447

[56] References Cited

U.S. PATENT DOCUMENTS

| | | | |
|---|---|---|---|
| 1,061,903 | 5/1913 | Farnum . | |
| 2,207,190 | 7/1940 | Carnahan . | |
| 3,592,471 | 7/1971 | Swimmer et al. | 273/109 |
| 3,829,088 | 8/1974 | Pahlas . | |
| 3,934,881 | 1/1976 | Goldfarb et al. . | |
| 4,333,655 | 6/1982 | Rudell et al. . | |
| 4,606,545 | 8/1986 | Ritchie | 273/121 A |
| 5,066,014 | 11/1991 | Dobson | 273/108 X |
| 5,149,095 | 9/1992 | Kashimoto et al. | 273/108 X |

*Primary Examiner*—Vincent Millin
*Assistant Examiner*—Raleigh W. Chiu
*Attorney, Agent, or Firm*—Nixon & Vanderhye

[57] ABSTRACT

A game in which an object, such as a ball, is maneuvered upon a meandering path upwardly slanting to a goal. The ball is directed along the path by a manipulating device, such as a rod. The ball is free to move laterally along an edge of the rod under the force of gravity as the rod is tilted from the horizontal, and the ball may be moved linearly (advanced or retracted) by sliding the rod forward or backward along the path.

18 Claims, 3 Drawing Sheets

GAME OF SKILL

FIELD OF THE INVENTION

The invention relates to the field of amusement games, in particular, to a game in which a player manoeuvres an object along a path to a goal.

PRIOR ART

The prior art discloses a number of games wherein a player manoeuvres a ball along a course to a goal. U.S. Pat. No. 1,061,903, issued to Farnum, dated May 13, 1913, teaches a game having a box containing a rectangular incline with a zig-zag groove cut in its face wherein balls, principally by force of gravity, are caused to traverse the grooves by tilting and manipulating the box. U.S. Pat. No. 3,829,088, issued to Pahlas, dated Aug. 31, 1972, teaches a magnetic game device wherein a steel ball or other magnetic ball is caused to traverse a track under the influence of a magnetized stylus. U.S. Pat. No. 3,934,881, issued to Goldfarb et al., dated Jan. 27, 1976, teaches an upright game board on which a plurality of tiltable, generally horizontally extending and staggered platforms are manipulated by a player to guide a plurality of balls from a higher platform to successively lower platforms.

The prior art also discloses games wherein obstacles along a course create challenges to a player manoeuvring a ball upon a course. U.S. Pat. No. 3,829,088 teaches a channel track having appropriately positioned holes which constitute obstacles to the progress of a magnetic ball along the channel. U.S. Pat. No. 4,333,655, issued to Rudell et al., dated Jun. 8, 1982, teaches an upright board game utilizing playing pieces movable along a path or paths wherein slidable or movable hazards or missiles physically remove the playing pieces from the path.

SUMMARY OF THE INVENTION

The present invention provides a novel and simple construction for an object and path type of game.

The game of the present invention generally comprises a path in an upwardly slanting plane, an object and a manipulating means to direct the object along the path to a goal. In describing this game in this specification the words "forward", "advance" or the like mean a direction up the slanted plane of the path from the bottom to the top. Conversely, "backward", "retract" or the like mean in the opposite direction from top to bottom. "Laterally" or "sideways" or the like mean a direction transverse to the forward or backward directions.

The path which constitutes the playing surface of the game meanders generally forwardly, laterally and sometimes backwardly in a plane slanting upward from a bottom starting point to a goal. If the game is successfully completed the object will be directed along the path to the goal. If the game is not completed successfully the object will fall from the path before it reaches the goal. The word "goal" is used generally in the sense of an end position and may assume any of a number of forms suitable to the background setting or context in which the game is played. For example, if the setting were a path through a group of soccer players on a field, then the goal could be a soccer net. Similarly, if the path were in a woodland setting, the goal could be a cabin. In preferred embodiments of the game of this invention the goal will include a return device as will be known in the art to return the object to the starting position.

The object to be moved along the path could be also configured to conform to the setting of the game. It could be a figure, a ball or any other object which would move freely under the force of gravity along an edge of the manipulating means. The object will also move freely on the slanted path under the force of gravity unless it is controlled by the manipulating means. If control of the object is lost it will move under its on weight until it falls from the path.

The manipulating means of this invention slides on guide means over the plane of the path but sufficiently close thereto to interact with the object when the object is on the path. However, the manipulating means is unable to interact with the object if it falls off the path. A player may tilt and slide the manipulating means along the guide means to manoeuvre the object along the path. The manipulating means interacts with the object in a number of ways. First by advancing, it may overcome the force of gravity to push the object up the path. Second by retracting, it may allow the object to move backwards along the path. Third by tilting (i.e. advancing one end of the manipulating means in advance of the other end) it allows the object to move laterally, away from the advanced end, along the edge of the manipulating means under the force of gravity. A rod, bar, plate or other similar means may be a suitable manipulating means provided it has an edge which is sufficiently long to extend across the path anywhere in the plane of the path. A handle may be secured at each opposing end of the manipulating means to allow a player to tilt and slide the manipulating means.

The guide means may be rails along both sides of the game adjacent the path. The manipulating means is guided by the guide means to remain in a plane slightly above the plane of the path so that the manipulating means may interact with the object when it is on the path of the game. The edges of a box or container which run parallel to the plane of the path and on either side of the path may form a suitable guide means. Other guide means may be used as are appropriate to the type of manipulating means selected and will be within the skill of the art. A transparent sheet may cover the game and contain the manipulating means (except for projecting handles), the guide means and the path. The sheet protects the game and interacts with the handles to limit the freedom to tilt the manipulating means.

The difficulty of the game is determined by the width of the path, the freedom of movement or lack of friction between the object and the edge of the manipulating means, the freedom of movement of the object along the path, the degree of the slant of the plane of the path and the inertial forces of the object and the manipulating means and the friction between the manipulating means and the guides upon which it moves. Further the manipulating means may be restricted at its ends by the guide means to limit the amount of tilt possible or to limit the potential for moving it laterally while maintaining it in a horizontal plane. It will be appreciated that the variables presented by the combination of this invention permit construction of a variety of games of a similar type but with different degrees of difficulty. It will also appreciated that the combination of this invention readily accommodates the introduction of other factors such as obstacles to make other interesting courses.

DESCRIPTION OF THE DRAWINGS

In drawings which illustrate a preferred embodiment of the invention.

DESCRIPTION OF THE PREFERRED EMBODIMENT

In the description of the preferred embodiment, similar numbers indicate similar elements.

Figure 1:
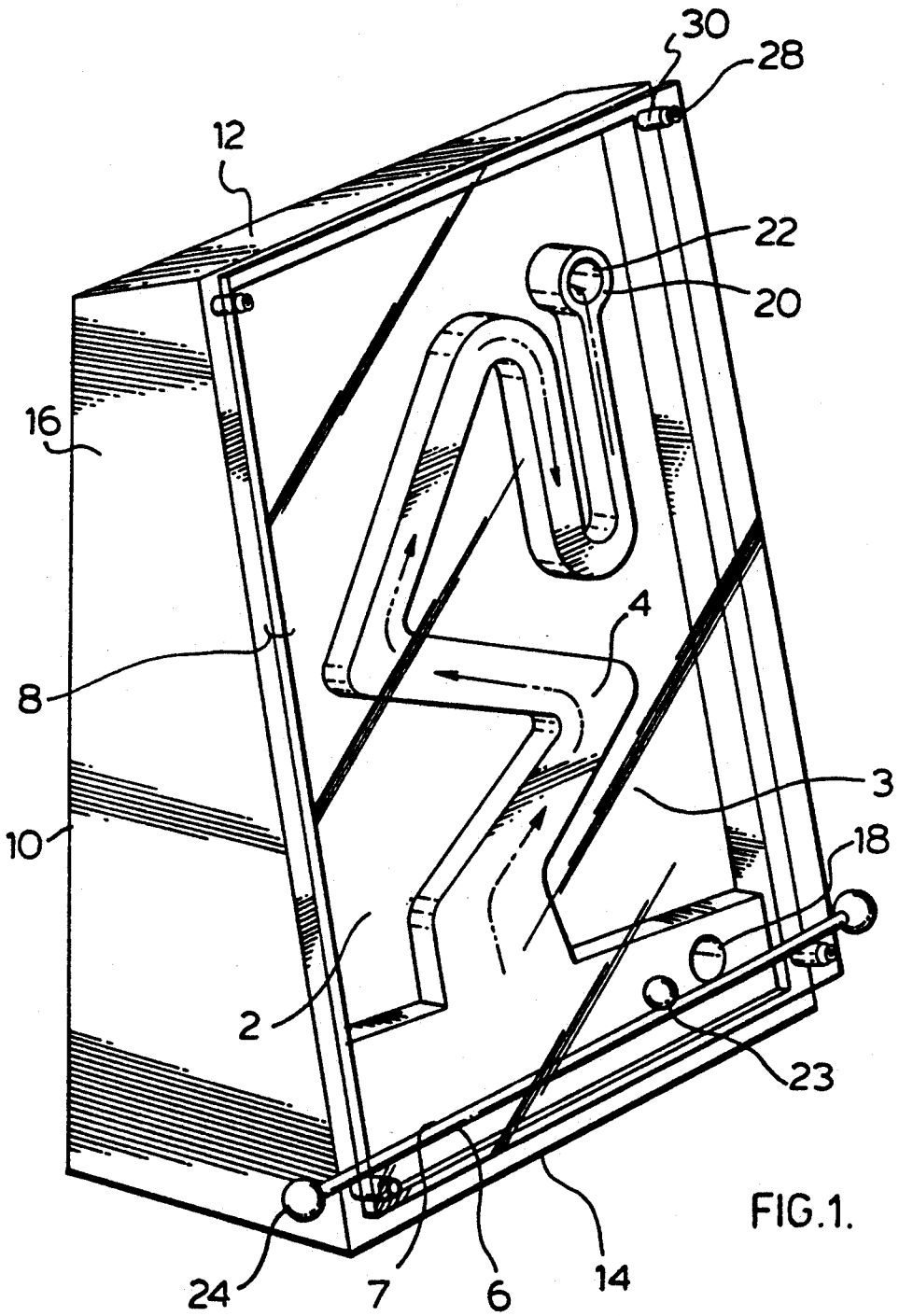
FIG. 1 is a perspective view of the invention.

Referring to FIG. 1, the preferred embodiment is a game comprised of a slanted board 2 having a front face 3, a meandering path 4 elevated upon the said front face 3, an object being a steel ball 23, a manipulating means being a steel rod 6 having a top edge 7 and guide rails 8. The board 2 is mounted within a support structure 10 which comprises a top panel 12, a bottom panel 14 and side panels 16. The support structure 10 may be made of any suitable material, such as wood.

Figure 2:
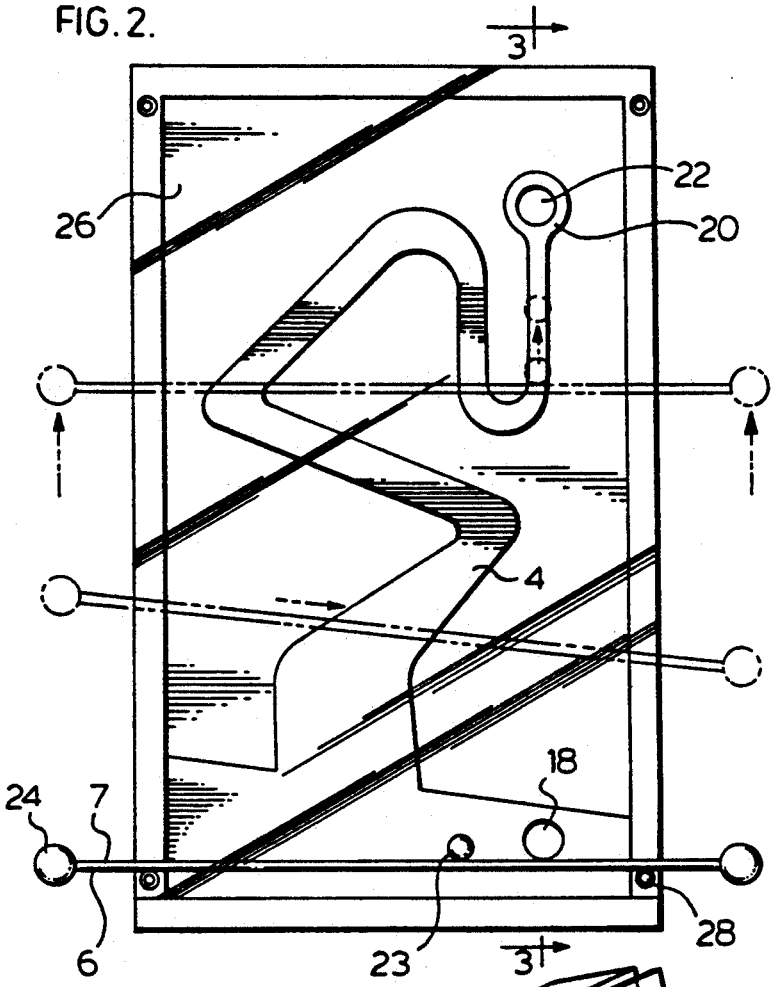
FIG. 2 is a front view illustrating the path of the invention.
Figure 4:
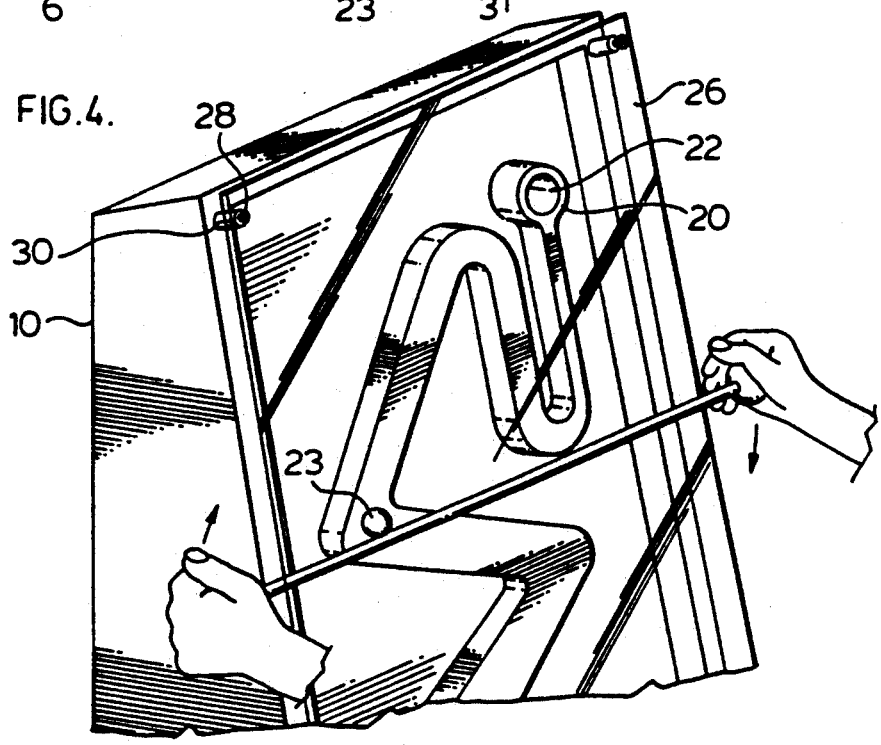
FIG. 4 is a perspective view of an upper portion of the invention.
Figure 3:
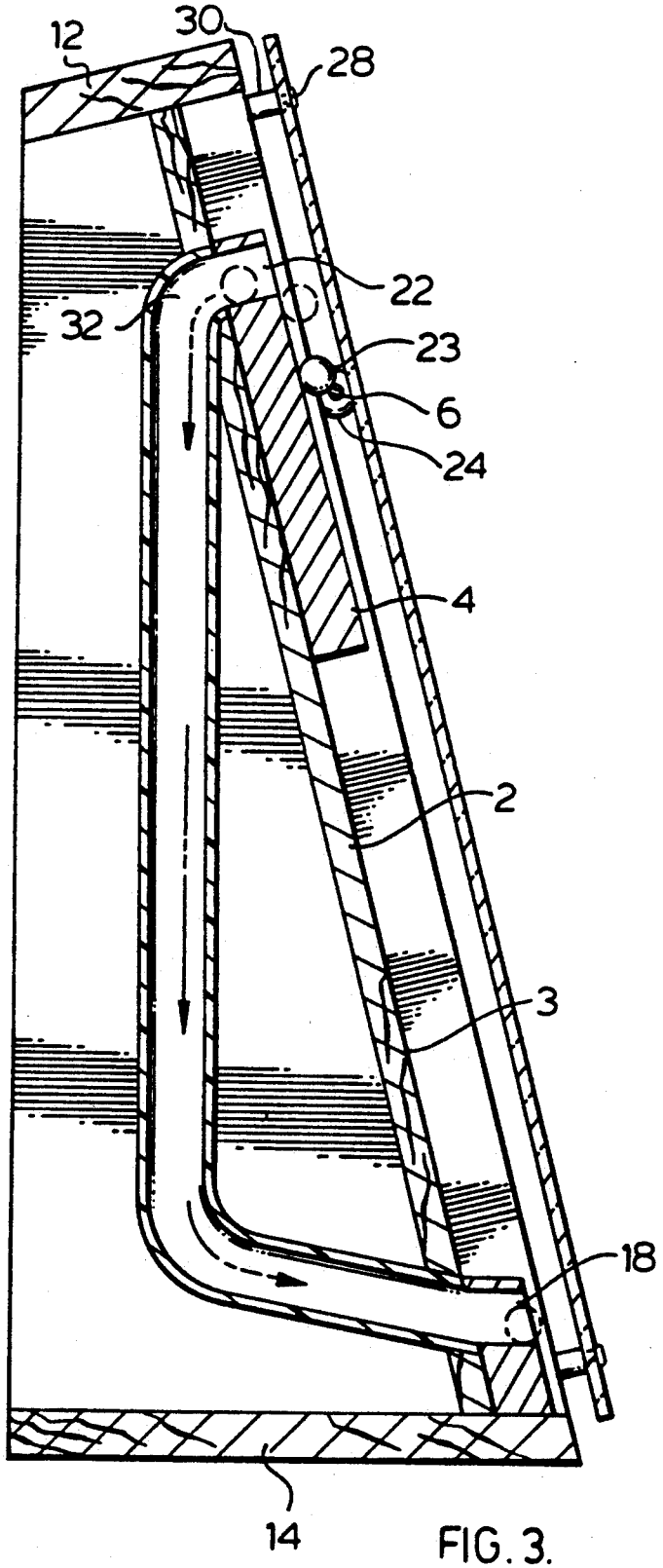
FIG. 3 is a sectional view taken generally along the line 3—3 of FIG. 2.

As shown in FIG. 2, the path 4 continues from a starting point 18 to a higher, terminal point 20. A goal 22 is located at terminal point 20 and is adapted to receive a ball 23. Ball 23 falls from the path 4 and returns to starting point 18 if it deviates from the path 4. The rod 6 may be advanced upwards above the path or retracted or tilted from side to side to control the rolling ball 23 which is free to roll along the rod 6 and along the path 4 as directed by the rod 6 until it reaches the goal or falls off the path. In this embodiment, a player is challenged while manoeuvring ball 23 to goal 22 by the fact that the width of path 4 decreases progressively between starting point 18 and terminal point 20 in relation to the diameter of ball 23. A handle 24 is secured at each opposing end of the rod 6 to facilitate a player to tilt and slide the rod 6. As seen in FIG. 4, the handles 24 are grasped by a player while playing the game. The rod 6, with top edge 7, sliding on guide rails 8, and manipulated by handles 24, comprises a manipulating means for manipulating the ball 23 (object means), the edge 7 having the freedom of movement to move linearly with respect to the path 4 traversed by the ball 23. Where the object means is the ball 23, it will be seen that it has more than one rolling surface (an infinite number of surfaces) which are free to roll along the path 4 and the rod 6 surface 7.

The rod 6 rides on the guide rails 8. In the preferred embodiment, the guide rails 8 are the edges of the side panels 16. A transparent front panel 26 is mounted spaced over the board 2 and the support structure 10. The transparent front panel 26 is supported spaced apart and parallel to the front of the board 2 on support structure 10 with suitable means such as screws 28 and spacers 30.

A return 32 connects goal 22 with the starting point 18. The return 32 is adapted to permit ball 22 to return to the starting point 18 upon successful completion of the game.

Various modifications and changes may be made in the specific structure illustrated without departing from the spirit and scope of the present invention as is defined in the appended claims.

The embodiments of the invention in which an exclusive property is claimed are defined as follows:

1. A game comprising a path in an upwardly slanting first plane, an object means to be moved over the path and having the freedom to move on the path under the force of gravity and free to fall off the path unless otherwise controlled, and a manipulating means for manipulating the object means, and having an edge in a second plane extending across and over the first plane to interact with and control the object means, said edge having the freedom of movement to move linearly with respect to the path to advance or retract, and to tilt clockwise or counterclockwise in said second plane when manipulated by a player.

2. A game according to claim 1 having guide means to maintain the manipulating means in the second plane over said first plane during manipulation.

3. A game according to claim 2 in which the object means is a ball, the manipulation means is a rod, and the guide means comprise edges of a support structure of the game which extend in a forward direction on either side of the path.

4. A game according to claim 2 wherein the manipulating means is a rod and the object means has one or more rolling surfaces which are free to roll along the path and the rod.

5. A game according to claim 2 in which the object means is a ball and the manipulation means is a rod.

6. A game according to claim 1 wherein the manipulating means is a rod and the object means has one or more rolling surfaces which are free to roll along the path and the rod.

7. A game according to claim 1 in which the object means is a ball and the manipulation means is a rod.

8. A game according to claim 1 in which the path is elevated over a board set in a support structure and in which the plane of the board is spaced apart from the second plane by a sufficient amount to permit an object means which has fallen off the path onto the board to pass under the manipulation means without interference.

9. A game according to claim 1 in which the object means is a ball, the manipulation means is a rod, and the guide means comprise edges of a support structure of the game which extend in a forward direction on either side of the path.

10. A game according to claim 9 in which the path is elevated over a board set in a support structure in which the plane of the board is spaced apart from the second plane by a sufficient amount to permit an object means which has fallen off the path on the board to pass under the manipulation means without interference.

11. A game comprising a path in an upwardly slanting first plane;

an object means to be moved over the path and having the freedom to move on the path under the force of gravity and free to fall off the path unless otherwise controlled;

a manipulating means having an edge in a second plane extending across and over the first plane to interact with and control the object means, said edge having the freedom of movement to advance or retract or to tilt clockwise or counterclockwise in said second plane under the manipulation of a player;

guide means for maintaining the manipulating means in the second plane over said first plane during manipulation; and wherein the object means is a ball, the manipulation means is a rod, and the guide means comprise edges of a support structure of the game which extend in a forward direction on either side of the path.

12. A game according to claim 11 wherein the manipulating means is a rod and the object means has one or more rolling surfaces which are free to roll along the path and the rod.

13. A game according to claim 11 in which the path is elevated over a board set in a support structure and wherein the plane of the board is spaced apart from the second plane by a distance sufficient to permit an object means which has fallen off the path onto the board to pass under the manipulation means without interference.

14. A game comprising a path in an upwardly slanting first plane;

an object means to be moved over the path and having the freedom to move on the path under the force of gravity and free to fall off the path unless otherwise controlled;

a manipulating means having an edge in a second plane extending across and over the first plane to interact with and control the object means, said edge having the freedom of movement to advance or retract or to tilt clockwise or counterclockwise in said second plane under the manipulation of a player; and wherein the path is elevated over a board set in a support structure and wherein the plane of the board is spaced apart from the second plane by a distance sufficient to permit an object means which has fallen off the path onto the board to pass under the manipulation means without interference.

15. A game according to claim 14 having guide means for maintaining the manipulating means in the second plane over said first plane during manipulation.

16. A game according to claim 15 wherein the object means is a ball, the manipulation means is a rod, and the guide means comprise edges of a support structure of the game which extend in a forward direction on either side of the path.

17. A game according to claim 14 wherein the manipulating means is a rod and the object means has one or more rolling surfaces which are free to roll along the path and the rod.

18. A game according to claim 14 in which the object means is a ball and the manipulation means is a rod.

* * * * *